US008272919B2

(12) United States Patent
Hornsby et al.

(10) Patent No.: US 8,272,919 B2
(45) Date of Patent: Sep. 25, 2012

(54) INTERACTIVE INTELLIGENT TOY

(75) Inventors: James Russell Hornsby, St. Louis, MO (US); Marcellus Benson, Chesterfield, MO (US); Joseph McGowan, St. Charles, MO (US); Michael Reynolds, St. Louis, MO (US)

(73) Assignee: Cepia, LLC, St. Louis, MO (US)

( * ) Notice: Subject to any disclaimer, the term of this patent is extended or adjusted under 35 U.S.C. 154(b) by 566 days.

(21) Appl. No.: 12/463,391

(22) Filed: May 9, 2009

(65) Prior Publication Data

US 2010/0261408 A1 Oct. 14, 2010

Related U.S. Application Data

(63) Continuation-in-part of application No. 12/384,993, filed on Apr. 13, 2009, now abandoned.

(51) Int. Cl.
*A63H 17/00* (2006.01)

(52) U.S. Cl. ..... 446/436; 446/272; 446/437; 446/441; 446/444

(58) Field of Classification Search ..... 446/69, 446/272, 275, 279, 280, 289, 292, 436, 441, 446/444, 462, 470

See application file for complete search history.

(56) References Cited

U.S. PATENT DOCUMENTS

| | | | | | |
|---|---|---|---|---|---|
| 3,453,921 | A * | 7/1969 | Hubiak et al. | ..... | 84/102 |
| 4,337,375 | A * | 6/1982 | Freeman | ..... | 704/260 |
| 4,556,397 | A | 12/1985 | Arad et al. | | |
| 4,752,272 | A | 6/1988 | Karasawa | | |
| 4,813,908 | A | 3/1989 | Oikawa et al. | | |
| 4,925,424 | A * | 5/1990 | Takahashi | ..... | 446/175 |
| 5,127,869 | A * | 7/1992 | Hanzawa | ..... | 446/397 |
| 5,478,240 | A * | 12/1995 | Cogliano | ..... | 434/327 |
| 5,816,886 | A * | 10/1998 | Cusolito | ..... | 446/444 |
| 6,066,025 | A * | 5/2000 | Wisniewski | ..... | 446/410 |
| 6,551,165 | B2 * | 4/2003 | Smirnov | ..... | 446/175 |
| 6,565,407 | B1 | 5/2003 | Woolington et al. | | |
| 6,695,668 | B2 * | 2/2004 | Donahue et al. | ..... | 446/175 |
| 7,014,525 | B2 * | 3/2006 | Abe et al. | ..... | 446/175 |
| 7,207,859 | B1 | 4/2007 | Iaconis et al. | | |
| 2002/0027837 | A1 * | 3/2002 | Weber | ..... | 369/14 |

(Continued)

OTHER PUBLICATIONS

Complaint filed in the U.S. District Court of the Northern District of California, dated Mar. 10, 2011, *Jason G. Heller* v. *Cepia, LLC* Case No. CV11-01146 in which the Assignee of the instant U.S. patent application is named as Defendant, 27 pages.

(Continued)

*Primary Examiner* — Gene Kim
*Assistant Examiner* — Joseph B Baldori
(74) *Attorney, Agent, or Firm* — Stinson Morrison Hecker LLP; Mark C. Young

(57) ABSTRACT

The present invention is directed to an interactive intelligent toy that provides the appearance and experience of a toy hamster moving in, and interacting with, its environment and habitat. In an exemplary embodiment, the interactive intelligent toy comprises an intelligent motive and control component enclosed by a cover resembling a hamster, with fur coat, eyes, ears, mouth, nose, and whiskers. The motive component includes a drive mechanism and circuitry operable to control the drive mechanism, monitor and detect user and event inputs, and detect and decode embedded codes from a pathway and perform predetermined actions or generate predetermined sounds in response. The motive component moves along and through a pathway component having one or more embedded codes detectable by the motive component, the embedded codes providing information to the motive component to direct desired action of the motive component.

5 Claims, 4 Drawing Sheets

U.S. PATENT DOCUMENTS

| | | | | |
|---|---|---|---|---|
| 2002/0102910 | A1 | 8/2002 | Donahue et al. | |
| 2006/0183405 | A1 * | 8/2006 | Mathews | 446/456 |
| 2008/0091305 | A1 | 4/2008 | Svendsen et al. | |

OTHER PUBLICATIONS

Axlon, Petster Owner's Manual and Training Guide, copyright 1985.
Tiger Electronics, Electronic Furby Instruction Manual, copyright 1999.
Sony, ERS-7 Entertainment Robot AIBO User's Guide (Basic), copyright 2003.
Hasbro, FurReal Friends Instruction Manual, copyright 2003.
Hamusuta Hamster Lil Find: Hamusuta, May 14, 2008. http://www.lilsugar.com/Hamusuta-Hamster-1624413.
Serkan Toto, Sega Toys presents a new robot animal, the dream hamster, Jul. 31, 2008. http://techcrunch.com/2008/07/31/sega-toys-presents-a-new-robot-animal-the-dream-hamster/.
Joshua Fruhlinger, Sega adds Dream Hamster to its Dream Pets collection, girls say "kawaiiii!", Jul. 31, 2008. http://www.engadget.com/2008/07/31/sega-adds-dream-hamster-to-its-dream-pets-collection-girls-say/.
U.S. Appl. No. 12/540,199, filed Aug. 12, 2009, Hornsby et al.
U.S. Appl. No. 12/572,610, filed Oct. 2, 2009, Hornsby et al.
U.S. Appl. No. 29/345,500, filed Oct. 16, 2009, Hornsby et al.
U.S. Appl. No. 29/345,506, filed Oct. 16, 2009, Hornsby et al.
U.S. Appl. No. 29/345,508, filed Oct. 16, 2009, Hornsby et al.
U.S. Appl. No. 29/345,513, filed Oct. 16, 2009, Hornsby et al.
U.S. Appl. No. 29/345,515, filed Oct. 16, 2009, Hornsby et al.
Iwaya Corp., Photograph of toy "Happy Chu's Day", item marked with copyright of 1997, 2007, 1 pg.
ABL Innovation Co., Ltd., Photograph of toy "Wheel Runner" (no date on product but it is believed to have been in public use for more than one year prior to Apr. 13, 2009, the priority date of the present application).
Photograph of toy "Kurukuru HamHam" (no date on product but it is believed to have been in public use for more than one year prior to Apr. 13, 2009, the priority date of the present application).
U.S. Appl. No. 29/314,493, filed Apr. 7, 2009, Homsby.
U.S. Appl. No. 12/384,993, filed Apr. 13, 2009, Homsby.
U.S. Appl. No. 12/790,047, filed May 28, 2010, Homsby.
Photograph of toy "Hamusuta The Happy Hamster" (no date on product but it is believed to have been in public use for more than one year prior to Apr. 13, 2009, the priority date of the present application).

* cited by examiner

INTERACTIVE INTELLIGENT TOY

CROSS-REFERENCE TO RELATED APPLICATIONS

This application is a continuation-in-part of, and claims priority to, U.S. Utility application Ser. No. 12/384,993, filed Apr. 13, 2009, entitled "Entertainment Device", which is hereby incorporated by reference herein in its entirety for all purposes.

STATEMENT REGARDING FEDERALLY SPONSORED RESEARCH OR DEVELOPMENT

Not applicable.

BACKGROUND OF THE INVENTION

1. Field of the Invention

The present invention relates to toy entertainment devices, and more particularly to motorized, movable toys.

2. Description of Related Art

Children all over the world enjoy pets, such as pet hamsters. Typically these pets live in habitats comprising tubes, tunnels, and the like. The habitats are assembled and expanded upon with accessories such as hamster balls or exercise wheels to enhance the entertainment value of the pet. The pets that dwell in these habitats move about under their own will and are very enjoyable to watch. Unfortunately, pet hamsters require a great amount of maintenance. For instance, pet hamsters require food and water, and generate waste that needs to be cleaned-up regularly.

Some robotic pets exist in the toy industry, but they do not provide the complete experience of a real pet. For example, many robotic toys require the use of a remote control or specific commands from a child to operate. Thus, while these existing toys provide some semblance of a "real" pet, they fall far short of providing an actual pet experience.

BRIEF SUMMARY OF THE INVENTION

The present invention is directed to an interactive intelligent toy that provides the appearance and experience of a toy hamster moving in, and interacting with, its environment and habitat. In an exemplary embodiment, the interactive intelligent toy comprises an intelligent motive and control component enclosed by a cover resembling a hamster, with fur coat, eyes, ears, mouth, nose, and whiskers. The motive component includes a drive mechanism and circuitry operable to control the drive mechanism, monitor and detect user and event inputs, and detect and decode embedded codes from a pathway and perform predetermined actions or generate predetermined sounds in response. The motive component moves along and through a pathway component having one or more embedded codes detectable by the motive component, the embedded codes providing information to the motive component to direct desired action of the motive component.

In use, as the motive component/hamster moves through the various sections of pathway, encountering "bump codes" embedded in the pathway while the control circuitry decodes the codes and directs the motive component to perform specific actions, move in specific ways, and generate specific sounds in response to the detected code. Thus, the appearance of the hamster moving through the pathway is that of a real pet hamster exploring and interacting with its environment and habitat.

In additional aspects of the invention, the motive component includes user operable switches to interact with the hamster, and operation in a free run or explore mode independent of the pathway component. Various alternative embodiments are described herein, and other variations and configurations are anticipated by the present invention. For example, while the invention is described herein primarily with respect to a configuration resembling a pet hamster, other configurations may be used, such as other pets (e.g., dogs, cats, mice, etc.) or vehicles (e.g., fire trucks, police cars, etc.) or any other desired configuration.

BRIEF DESCRIPTION OF THE DRAWINGS

The present invention will be described in greater detail in the following detailed description of the invention with reference to the accompanying drawings that form a part hereof, in which.

DETAILED DESCRIPTION OF EXEMPLARY EMBODIMENTS

An interactive intelligent toy in accordance with an exemplary embodiment of the present invention is depicted in FIGS. 1-7. While the invention will be described in detail hereinbelow with reference to this exemplary embodiment and alternative embodiments, it should be understood that the invention is not limited to the specific configurations shown and describe in these embodiments. Rather, one skilled in the art will appreciate that a variety of configurations may be implemented in accordance with the present invention.

Figure 1:
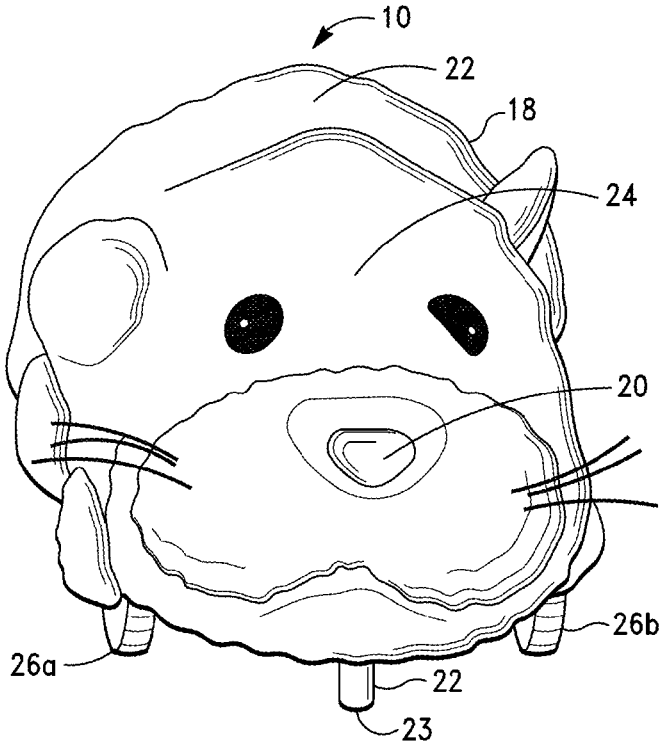
FIG. 1 is a perspective view of a motive component of an interactive intelligent toy in accordance with an exemplary embodiment of the present invention.
Figure 2:
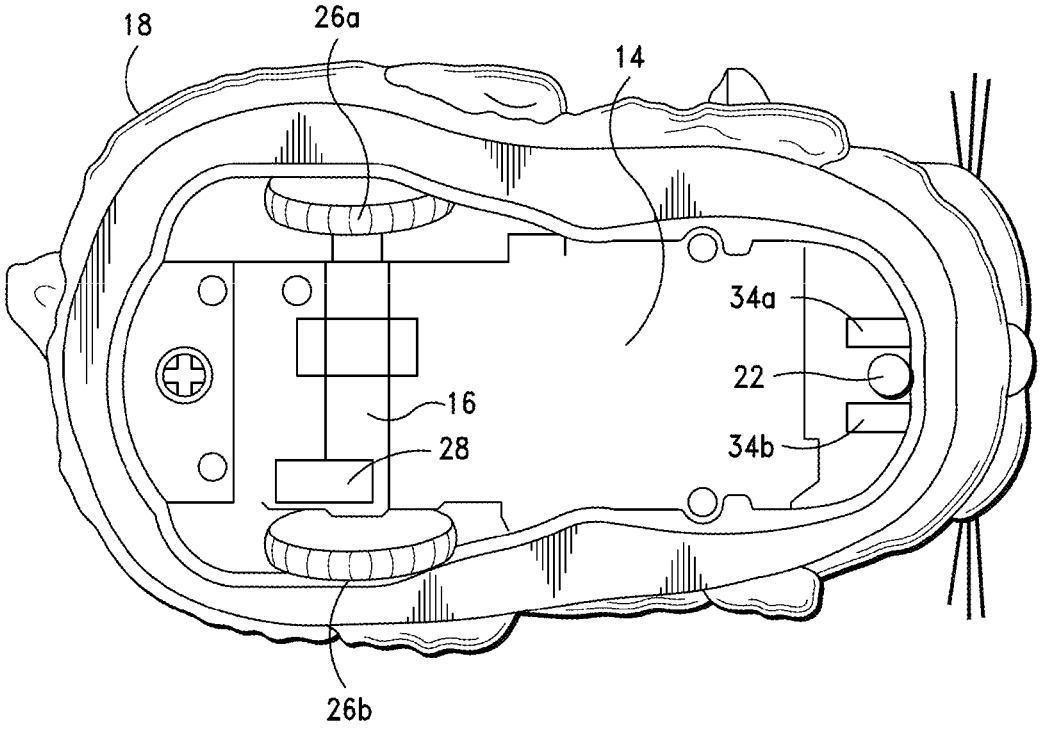
FIG. 2 is a bottom view of the motive component of FIG. 1.
Figure 3:
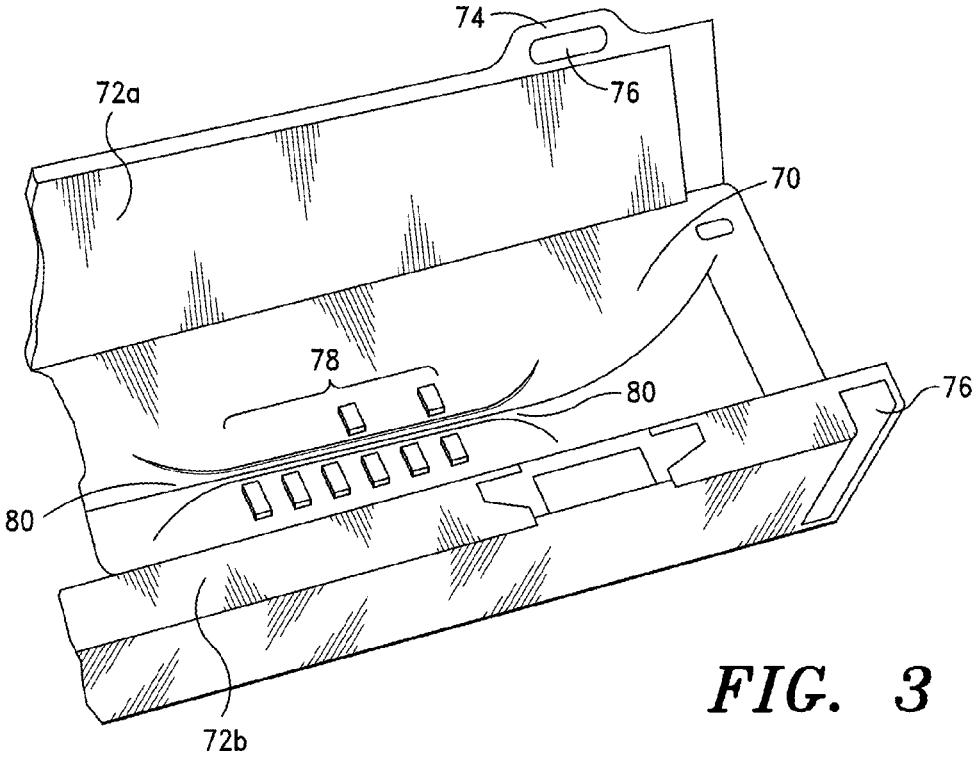
FIG. 3 is an enlarged partial view of a portion of a pathway component showing a bump code comprising a series of raised bump code formed in the pathway.

Looking first to FIGS. 1-3, an interactive intelligent toy in accordance with an exemplary embodiment of the present invention comprises: (1) an intelligent motive and control component 10 (FIG. 1) having a drive mechanism and circuitry operable to control the drive mechanism, monitor and detect user and event inputs, and detect and decode embedded codes from a pathway and perform predetermined actions or generate predetermined sounds in response; and (2) a pathway component 12 (FIG. 3) having one or more embedded codes detectable by the motive component, the embedded codes providing information to the motive component to direct desired action of the motive component.

As depicted in FIGS. 1-3, motive component 10 and pathway component 12 preferably resemble a pet hamster and its habitat, respectively, with the interactive intelligent toy of the present invention allowing one or more pathway components and one or more motive components to be configured, assembled and used in various combinations to simulate the environment, habitat and actions of an actual pet hamster or other pet animal. The control circuitry communicates with various switches and sensors on the motive component to detect user or environment/habitat inputs and provides apparent intelligent control to the toy, for example, by generating sounds or actions in response to various detected embedded codes in the pathway and by altering the movement of the motive component in response to a detected obstacle. The overall effect of the combined intelligent motive component and pathway component is that of an intelligent animal (e.g., a hamster) exploring and interacting with its habitat and environment. Other embodiments are contemplated by the present invention. For example, the motive device could be covered to resemble different animals, or could be covered to resemble a vehicle such as a fire truck or police car, with the corresponding pathway component configured to resemble the related habitat for that particular motive component, e.g. a fire station, buildings, etc.

Looking to FIGS. 1 and 2, motive component 10 comprises a chassis 14, which houses control circuitry and batteries (as described in more detail below) and supports a drive mechanism 16, with a decorative cover 18 positioned over and covering the top portion of the chassis.

Cover

As best seen in FIG. 1, cover 18 is configured to resemble a pet hamster having a fur coat with eyes, ears, nose and whiskers. Control switches (described in more detail below) in communication with the control circuitry are positioned on or embedded under cover 18 such that the switches can be activated through the cover by pressure applied to the corresponding area of the cover. Preferably, the control switches are activated by a user pressing the corresponding area of the cover or by the action of the motive component bumping into an object or obstacle during movement in its habitat or environment. Operation or activation of each control switch provides a signal to the control circuitry to perform a specific action.

For example, cover 16 preferably includes a bump sensor switch located under the nose 20 of the hamster operable to detect the front of the motive component bumping into an obstacle when the motive component is in motion. That same switch also serves as a "try me" switch activated by a user to initiate a demonstration mode when the toy is packaged for display or sale. A control switch positioned on the back 22 of the hamster is preferably operable to wake the toy from a "sleep mode" and to turn on and off an "explore" mode, with a control switch positioned at the head 24 of the hamster preferably operable to wake the toy from sleep mode, turn off the explore mode, and to generate predetermined sounds simulating cooing and/or speech. As will be described in more detail below, the control circuitry of the motive component is operable to detect activation of the various control switches and to command the motive component to perform various actions in response to activation of the control switches, or to various combinations of the control switches.

Chassis

Looking to FIG. 2, chassis 14 includes a drive mechanism 16 positioned near the rear of the chassis operable to transport motive component 10 in forward or reverse directions, with a glide post 22 positioned at the center front portion of the chassis that functions: (1) to guide the motive component to follow a groove or raceway in a pathway or surface such as a channel or path formed to guide the motive component between a series of raised bumps formed in the pathway defining a bump code (as will be described in more detail below); (2) to elevate the front portion of the motive component from a surface so that the cover 18 does not drag and impede the travel of the motive component; and (3) to provide a contact surface 23 allowing the motive component to glide across a smooth surface. Glide post 22 also allows the motive component to make sharp turns or pivot, particularly when turning in reverse as described below.

Drive mechanism 16 preferably comprises a direct current motor in mechanical communication with wheels 26*a*, 26*b* so that rotation of the motor rotates the wheels to transport the motive component forward or backward. The motor is in electrical communication with the control circuitry which provides power to the motor, with the capability to switch the polarity of the command signal to drive the motor in either a forward or reverse direction.

A kickstand 28 coupled to the drive mechanism is positioned near wheel 26*b*, and is operable to extend when the drive mechanism rotates in a first direction and to retract when the drive mechanism rotates in a second direction. When the kickstand extends, it contacts the surface to raise the side of chassis 14 near wheel 26*b* so that wheel 26*b* is lifted slightly or entirely off of the surface. Thus, activation of the kickstand effectively disables the associated wheel so that only one wheel is engaged with the surface, causing the motive component to turn in a sharp arc. Preferably, the kickstand extends when the drive mechanism rotates in reverse, and retracts when the drive mechanism rotates forward so that the motive component turns in a sharp arc in reverse. Most preferably, wheels 26*a* and 26*b* are approximately the same size so that forward rotation of the motor drives each wheel equally such that the motive component moves in a substantially straight path forward.

Figure 7:
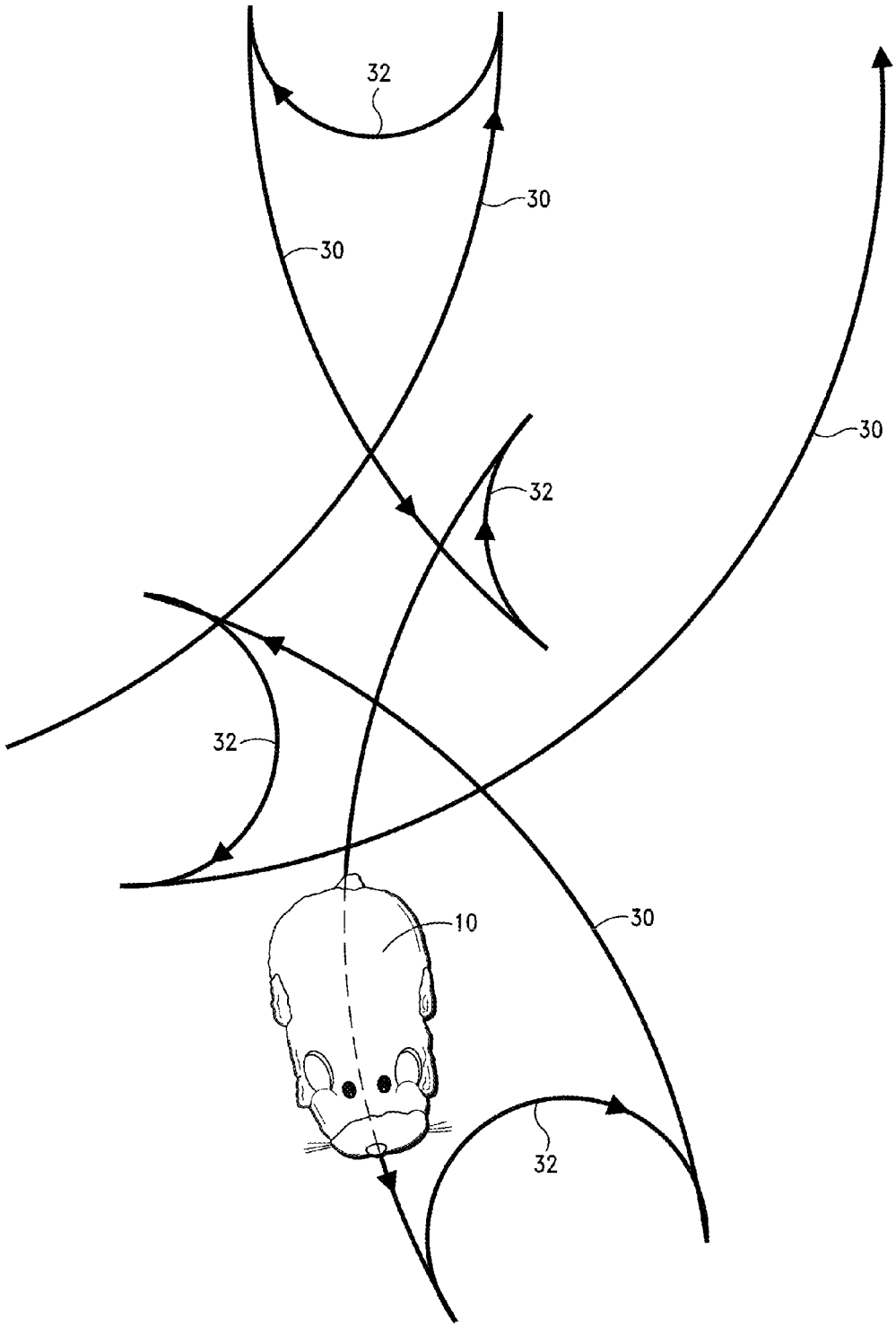
FIG. 7 is a diagram of a forward and reverse motion pattern of the motive component of FIG. 1.

Other arrangements of the drive mechanism, wheels, and kickstand are contemplated by the present invention. For example, wheel 26*a* could be a slightly larger diameter than wheel 26*b* so that forward or reverse motion of the motive component would be in gradual arc rather than in a straight line. As depicted in FIG. 7, in conjunction with the kickstand as just described, such a configuration would result in motive component 10 moving in a gradually arced path 30 when moving in a forward direction, and moving in a sharply arced path 32 when moving in reverse. The distance moved in each of the forward and reverse directions is be controlled by predetermined timing intervals in the control circuitry, by random timing intervals in the control circuitry, by detection of obstacles thorough a control switch (e.g., the nose bump switch) as previously described, or combinations thereof.

As seen in FIG. 7, the overall effect of the combination of relatively short forward and reverse movement of the motive component, with the direction changes, is that of a hamster exploring its habitat. Other variations in the combination of wheel size, kickstand operation, and timing of forward and reverse movement will be apparent to those skilled in the art and are within the scope of the present invention. For example, a slip gear, kickout gear, or sloppy axle could be used in the drive mechanism instead of the kickstand to provide sharp turning of the motive component in a particular direction. Or, separate drive motors for each wheel or adjustable gearing to vary the drive ratio of each wheel could be implemented.

Looking again to FIG. 2, bump code sensors 34*a*, 34*b*, positioned on opposite sides of glide pin 22, are operable to detect a series of bumps in the pathway defining a "bump code", the bump code being decoded by the control circuitry and defining a desired action of the motive component as will be described in more detail below. Preferably bump code sensors 34*a*, 34*b* are mechanical spring-loaded pushbutton type switches operable to actuate as they are depressed by a series of raised bumps passing under and contacting the sensors as the chassis is transported across the series of bumps. Bump code sensors 34*a*, 34*b* are in electrical communication with the control circuitry described below, which is operable to decode the sequence/series of bumps detected into a desired action of the motive component.

Preferably, bump code sensors 34*a*, 34*b* are inexpensive mechanical type switches that interface to the control circuitry with no additional power requirements. However, other types of sensors may be used (with corresponding changes to the type of codes implemented in the pathway component) in accordance with the present invention. For example, sensors 34*a*, 34*b* could be infrared (IR) readers operable to detect a corresponding bar code label on the pathway component. Or, the sensors could be a radio frequency identification transponder operable to activate and capture data from an RFID tag embedded in the pathway component.

Control Circuitry

Figure 5:
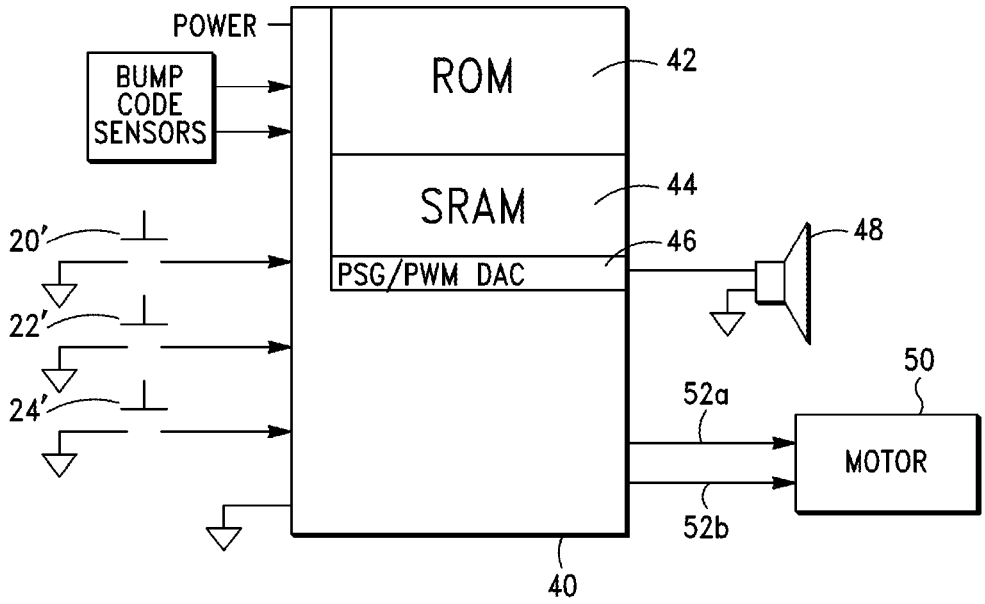
FIG. 5 is a block diagram of the control circuitry of the motive component of FIG. 1.

Turning to FIG. 5, a block diagram of an exemplary embodiment of control circuitry of the interactive intelligent toy is depicted. The control circuitry includes a microcontroller 40 operable to execute programmed instructions, to monitor inputs and control outputs according to those programmed instructions, and to generate sound signals. Micro controller 40 may be any microcontroller known in the art having the capabilities to perform the functions described herein. Preferably, microcontroller 40 includes onboard Read Only Memory (ROM) 42, Static Random Access Memory (SRAM) 44, and a Programmable Sound Generator (PSG) having a Pulse Width Modulated (PWM) Digital to Analog Converter (DAC) 46.

Read Only Memory (ROM) 42 stores the program code and instruction that are executed by the microcontroller which defines the operation of the motive component. ROM 42 also stores the audio data files used by the microcontroller to generate sounds. Preferably the audio data files are in ".wav" format, although other audio file formats known in the art may equally be used with appropriate decoding software running on the microcontroller. ROM 42 may also store any other programming, audio, data, or configuration parameters as required. As is known in the art, ROM 42 provides essentially permanent storage of the program code, audio data files, and other data or instructions stored thereon, retaining that data even when no power is applied to the ROM. Static Random Access Memory (SRAM) 44 provides temporary storage for data and variables generated by and used by the microcontroller as the program executes. As is known in the art, SRAM 44 stores data only when power is applied.

Programmable Sound Generator (PSG) and Pulse Width Modulated (PWM) Digital to Analog Converter (DAC) 46 provides the capability to convert audio data to an electrical signal, as is known in the art. The electrical signal is transmitted to speaker 48 which converts the electrical signal to an acoustical wave, preferably in the form of a human-perceptible sound. Speaker 48 is preferably a miniature Mylar speaker positioned on the chassis 14 of the motive component as described above. Of course other types of speaker devices, such as piezoelectric transducers, may also be used.

Microcontroller 40 controls motor 50 through lines 52*a*, 52*bb* that provide a voltage and current output to the motor. Motor 50 is the direct current motor portion of the drive mechanism 16 portion of the motive component as described above. Microcontroller 40 is operable to switch the polarity of the signals provided through lines 52*a*, 52*b* to drive the motor in either the forward or reverse directions to control the movement of the motive component.

Switches 20', 22', and 24' (corresponding to the nose, back, and head portions of the cover 18 as described above) provide inputs to microcontroller 40 indicating operator input or input due to contact of the motive component with an obstacle. For example, activation of switch 20' corresponds to the nose of the motive component, indicating that the motive component has bumped into an obstacle. Activation of switch 22' or 24' correspond to the back and head portions, respectively of the cover 18, indicating user interaction with those areas. For example, activation of switch 24' (corresponding to the head portion of the hamster) indicates that a user is touching or stroking the hamster's head. In response, microcontroller 40 activates a cooing or voice audio file to produce that sound through speaker 48. From the user's perspective, stroking the hamster's head causes it to coo. Similarly, the other input switches cause the microcontroller to perform specific actions. Activation of the nose switch 20' indicates that the hamster has bumped into an obstacle. In response, the microcontroller reverses the direction of motor 50 to change the direction the hamster is traveling. It will be apparent to those skilled in the art that various combinations of inputs thus could instigate various actions by the microcontroller to control the movement and/or sound of the motive component/hamster.

Bump code sensors (corresponding to bump code sensors 34*a*, 34*b* described above) provide inputs to the microcontroller 40 and correspond to the bump code sensors located on either side of the glide pin 22 on the chassis 14 as described above. Microcontroller 40 is operable to detect the inputs from the bump code sensors and to decode the various bit patterns detected according the bump code protocol described below. Upon detecting and decoding a bump code, the microcontroller performs specific actions according to that bump code. Power to the microcontroller is preferably provided by three AAA size batteries positioned on the top side of chassis 14 described above.

Microcontroller 40 is preferably a single integrated circuit (IC) having all of the functionality of the ROM 42, SRAM 44, and PSG/PWM DAC 46 on-board and built-in. However, other arrangements, configurations and variations are within the scope of the present invention. For example, the ROM, SRAM and DAC could each be discrete components controlled by a discrete microprocessor IC. Or the PSG/PWM DAC and speaker functionality could be built or combined into a separate device.

Pathway Component

Figure 4:
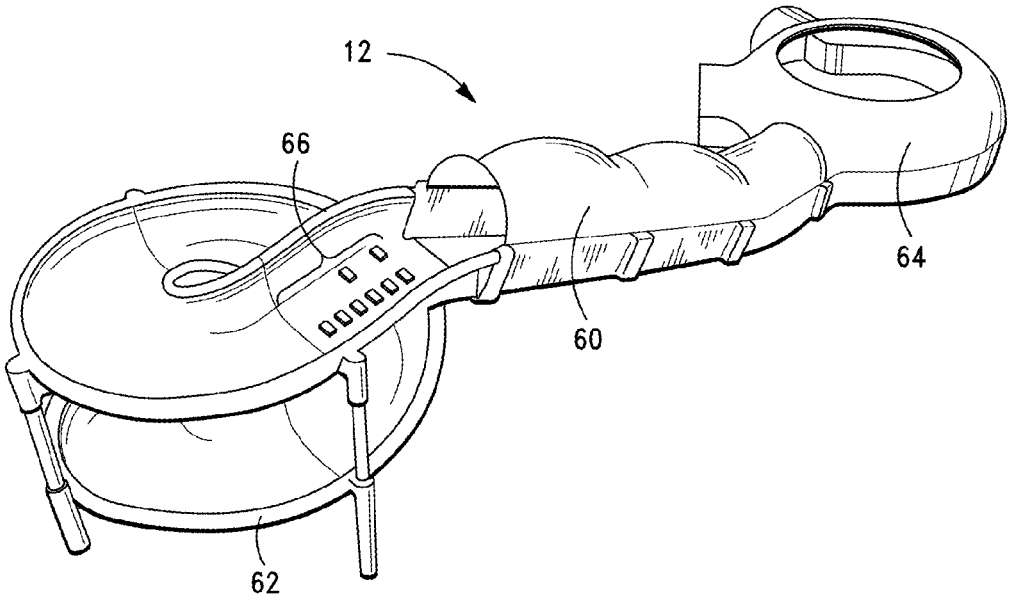
FIG. 4 is a perspective view of a plurality of pathway components of an interactive intelligent toy in accordance with an exemplary embodiment of the present invention.

Looking to FIGS. 3 and 4, pathway component 12 comprises one or more sections of pathway configured as a tube or tunnel 60, a circular slide 62, or room 64. As will be apparent, pathway components may likewise be configured or designed as any desired configuration corresponding to hamster habitat pieces and devices as used with an actual pet hamster, such as exercise wheels, or may be configured and designed as other whimsical or toy devices, such as cars or trucks. Thus, it should be understood that the pathway components described and depicted in the exemplary embodiments described herein are exemplary in nature, and not limiting of the scope of the present invention.

Looking to FIG. 3, a close-up partial view of a portion of an exemplary pathway component shows that the pathway component includes a floor surface 70 with walls 72*a*, 72*b* extending upwardly from opposite sides of the floor to form a semi-enclosed pathway. Viewed in conjunction with the motive component described previously, it can be seen that the motive component can move along the floor surface 70 of the pathway, guided and contained by the walls 72*a*, 72*b* on either side. Thus, looking to FIG. 4, it can be seen that the motive component can move along various configurations of the pathway component, such as a circular slide 62 or a tunnel or tube 64.

Looking back to FIG. 3, the pathway component includes one or more tabs 74 and receptacles 76 configured to interlock with corresponding tabs and receptacles similarly positioned on additional pathway components so that multiple pathway components can be connected together to form a complete habitat. As seen in FIG. 4, various pathway components (circular slide 62, tunnel 60, and room 64) are connected together in an exemplary habitat.

The pathway component includes a bump code 78, comprising a series of raised bumps formed in the floor surface 70, with guide recesses 80 formed in the floor surface at opposite ends of the bump code to direct the glide pin 22 of the motive component between the two rows of raised bumps. Thus, the bump sensors 34*a*, 34*b* of the motive component are each aligned with the corresponding rows of bumps to detect those bumps as the motive component is transported past the bump code, activating bump sensors 34*a*, 34*b* as previously described.

Thus, the pathway components not only generally direct the motive component, but also align the motive component to detect the bump codes formed in the pathway. While the bump codes are preferably raised bumps formed in the pathway, it should be understood that other detectable codes could be used within the scope of the present invention. For example, the codes in the pathway could be bar codes detectable by a corresponding IR sensor on the motive component, or the codes could be RFID tags detectable by a corresponding RFID transponder on the motive component.

Looking to FIG. 4, it should be apparent that pathway component room 64 does not have a floor having bump codes, but instead acts as a connector for multiple tubes, tunnels, or other pathway components which preferably themselves include a bump code to direct the motive component as it enters and/or exits the room.

Bump Code Protocol

Figure 6:
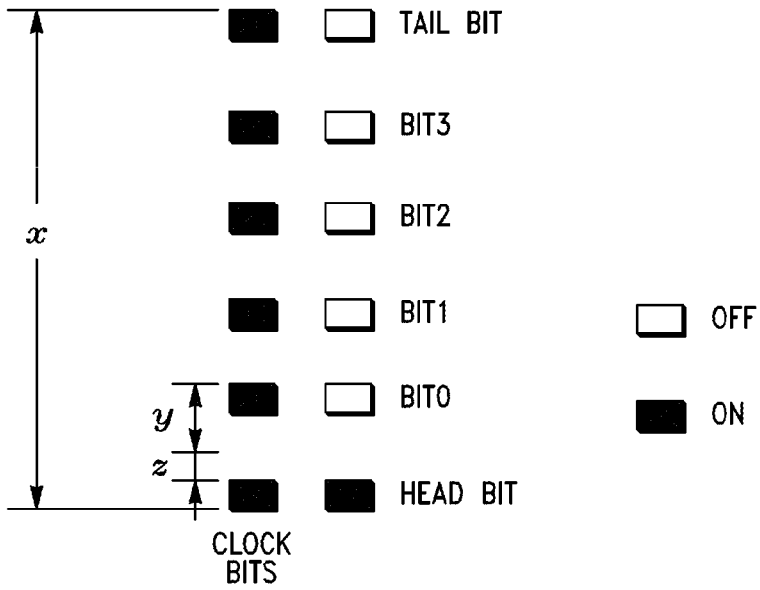
FIG. 6 is a diagram of the encoding protocol of the bump pattern formed in the pathway.

Turning to FIG. 6, an exemplary arrangement of the bump code pattern and protocol is depicted. The bump code is arranged in a 2 by 6 bit pattern, i.e., two rows, each having six bits. In the exemplary pattern shown, one row serves as a clock bit row for the first bump code sensor (e.g., bump sensor 34*a*, indicating when that sensor has contacted the clock bit bump) so that the control circuitry can then read the data from the second sensor (e.g., bump sensor 34*b*) by microcontroller 40 decoding the input data as described above. The spacing of the bits of the bump code pattern is preferably such that the overall length x of the pattern is at least 42 millimeters, with the total distance between the trailing edges of successive bits y+z at least 6 millimeters, and a minimum of 1 millimeter z between the trailing edge and leading edge of successive bits.

As depicted in FIG. 6, the 2 by 6 bit pattern with clock bits provides four data bits (bit 0, bit 1, bit 2, and bit 3), which correspond to sixteen unique codes that can be encoded by the bump code pattern. Those sixteen codes are detected and decoded by the control circuitry to perform various actions and generate various sounds. For example, looking to FIG. 4, a motive component/hamster traveling up tube 60 to circular slide 62 encounters a bump code 66 that preferably indicates that the pathway component is a circular slide. The bump code is detected and decoded by the control circuitry which then performs the actions associated with the circular slide bump code, e.g., generate a "wheee" sound that plays through speaker 42 as the hamster travels down the slide.

It should be understood that the bump code as described may be bidirectional, such that a series of bumps that provide a specific bit pattern in one direction may, and likely will, provide a different bit pattern when read in a different direction. Thus, for example, a single bump code located on a portion of pathway adjacent a room section may provide one code when the motive component passes over the bump code upon entering the room (i.e., an entrance code) and may provide another code when the motive component passes over that same bump code upon exiting the room (i.e., an exit code). It should also be understood that the control circuitry of the motive component may ignore specific codes or undefined codes, or that the exemplary bit pattern as just described may be expanded to provide more bits and thus a correspondingly greater number of available codes.

It should also be apparent that various bump codes to indicate various pathway components can be implemented, for example a code indicating an exercise wheel component would instigate an exercise wheel sound, with the motive component moving on that wheel for a predetermined time, or entering a game room pathway component would instigate sounds corresponding to playing games, and so forth. It should also be understood that the actions performed by the motive component in response to a specific code need not be the same each time that particular code is encountered. For example, the control circuitry may have a list of numerous "game room" responses so that each time the motive component enters a game room a different sound and/or movement response is selected from the list (either sequentially or randomly) and that response is commanded by the control circuitry. Thus, the actions of the motive component appear more intelligent and random than if only a single response were provided.

Looking once more to FIG. 4, when motive component is moving within a room component 44, there is no floor or any embedded codes. Thus, the motive component may move in a random pattern within the room, forward and backward, detecting bumping into the walls of the room via the nose bump sensor (and backing up) until it can exit the room through one of the tunnels, tubes, or other pathways connected to the room. Preferably, a pathway component portion on the entrance to the room provides an indication as to the type of room being entered (e.g., a game room) so that the control circuitry can play the appropriate sounds when the motive component enters that room. Also, a pathway component exiting the room preferably includes a bump code that signals the control circuitry to generate a new sound and/or perform different actions of the motive component as it exits.

Similar to the action of the motive component in a room as just described, the motive component can operate in a "free run" mode, apart from any pathway component. In that case, the control circuitry commands the motive component to travel in a generally straight line for predetermined time periods, then reversing. Or, the motive component could be commanded to move in an "explore" pattern similar to that depicted in FIG. 7, with the hamster moving in a short series of forward and backward motions. Preferably, the control circuitry commands that sounds be played thorough speaker 42 during free run mode.

Operation

In operation, the motive component 10 and pathway component 12 of the present invention interact to provide an apparently intelligent, interactive toy resembling a pet hamster exploring its habitat. As the motive component travels through various pathway components, bump codes formed in the pathway components are detected by bump code sensors 34*a*, 34*b* and decoded by the control circuitry. The decoded bump code is correlated to one or more desired sounds, actions, or combinations of sounds and actions, and the control circuitry commands those sounds and actions to take place.

Thus, as can be seen from the above-described exemplary embodiments, the interactive intelligent toy of the present invention provides a realistic, interactive toy that appears to explore and react to its environment and habitat by responding to the codes of the various pathways, rooms, and the like that it encounters in its habitat. The overall effect of the movement and reaction to its environment gives the appearance of an actual pet hamster exploring its environment in an intelligent, interactive manner. Additional user-operable input switches also allow a user to interact with the motive component, such as by stroking the hamster's head to cause it to coo or talk.

The term "substantially" or "approximately" as used herein may be applied to modify any quantitative representation which could permissibly vary without resulting in a change in the basic function to which it is related. For example, wheels 26*a*, 26*b* are described as being approximately the same size but may permissibly vary from that if the variance does not materially alter the capability of the invention.

While the present invention has been described and illustrated hereinabove with reference to various exemplary embodiments, it should be understood that various modifications could be made to these embodiments without departing from the scope of the invention. Therefore, the invention is not to be limited to the exemplary embodiments described and illustrated hereinabove, except insofar as such limitations are included in the following claims.

What is claimed and desired to be secured by Letters Patent is as follows:

1. An interactive intelligent toy, comprising:

a motive component comprising a drive mechanism including a motor operable to rotate first and second wheels in a first direction and a second direction, control circuitry operable to control direction of rotation of said motor to thereby move said motive component in said first and second directions, and mechanical switches operable to detect raised bumps in a surface under said motive component and to actuate to enable detection of a code associated with said raised bumps;

wherein said control circuitry is programmed to randomly implement an action of said motive component in response to said detected code such that said control circuitry does not cause said motive component to perform said action in response to said detected code every time said code is detected.

2. The interactive intelligent toy of claim 1, wherein said control circuitry is operable to communicate with said drive mechanism and wherein said control circuitry commands said drive mechanism.

3. The interactive intelligent toy of claim 1, wherein said control circuitry is programmed to randomly generate a sound in response to said detected code, such that said control circuitry does not generate a sound in response to said detected code every time said code is detected.

4. The interactive intelligent toy of claim 1, wherein said action comprises at least one predetermined action.

5. The interactive intelligent toy of claim 4, wherein said predetermined action comprises a movement action, a sound action, or combinations thereof.

* * * * *